US010301833B1

(12) United States Patent
Kim et al.

(10) Patent No.: US 10,301,833 B1
(45) Date of Patent: May 28, 2019

(54) HIGHLY DURABLE TEXTILE REINFORCING PANEL USED AS CONCRETE FORM, AND METHOD OF CONSTRUCTING REINFORCED CONCRETE STRUCTURE USING THE SAME

(71) Applicant: KOREA INSTITUTE OF CIVIL ENGINEERING AND BUILDING TECHNOLOGY, Gyeonggi-do (KR)

(72) Inventors: Hyeong Yeol Kim, Gyeonggi-do (KR); Gum Sung Ryu, Gyeonggi-do (KR); Dong Woo Seo, Gyeonggi-do (KR); Young Jun You, Gyeonggi-do (KR)

(73) Assignee: KOREA INSTITUTE OF CIVIL ENGINEERING AND BUILDING TECHNOLOGY, Gyeonggi-Do (KR)

( * ) Notice: Subject to any disclaimer, the term of this patent is extended or adjusted under 35 U.S.C. 154(b) by 0 days.

(21) Appl. No.: 15/836,919

(22) Filed: Dec. 11, 2017

(30) Foreign Application Priority Data

Nov. 3, 2017 (KR) ..... 10-2017-0146077

(51) Int. Cl.
*E04B 1/16* (2006.01)
*E04B 2/86* (2006.01)
(Continued)

(52) U.S. Cl.
CPC ..... *E04G 9/10* (2013.01); *E04B 1/167* (2013.01); *E04B 2/8635* (2013.01); *E04C 2/044* (2013.01); *E04G 9/02* (2013.01); *E04B 2103/02* (2013.01)

(58) Field of Classification Search
CPC ... E04G 9/10; E04G 9/02; E04B 1/167; E04B 2/8635; E04B 2103/02; E04C 2/044
See application file for complete search history.

(56) References Cited

U.S. PATENT DOCUMENTS 4,283,896 A * 8/1981 Fricker ..... E04C 2/044 52/309.11
4,690,368 A * 9/1987 Heiman ..... E04G 11/18 249/113

(Continued)

FOREIGN PATENT DOCUMENTS

DE 2603340 A1 * 8/1977 ..... E04B 5/38
GB 2164367 A * 3/1986 ..... B28B 19/003

(Continued)

*Primary Examiner* — Rodney Mintz
(74) *Attorney, Agent, or Firm* — JCIPRNET

(57) ABSTRACT

Provided are a highly durable textile reinforcing panel used as a concrete form and a method for constructing a reinforced concrete structure using the same. The highly durable textile reinforcing panel is configured to resist a lateral pressure caused due to a self-load of concrete which is not cured during construction and function as a structure reinforcing material by being integrated with concrete cured after the construction, is integrated with the concrete structure via a textile shear connector formed on a highly durable concrete panel, and allows a lattice-shaped reinforcing material to remarkably increase flexural strength of the highly durable concrete panel, and thus a flexural strength of the entire concrete structure is remarkably increased when the highly durable textile reinforcing panel used as a concrete form is structurally integrated with the concrete structure.

11 Claims, 7 Drawing Sheets

(51) Int. Cl.

| | |
|---|---|
| ***E04C 2/04*** | (2006.01) |
| ***E04G 9/02*** | (2006.01) |
| ***E04G 9/10*** | (2006.01) |

(56) References Cited

U.S. PATENT DOCUMENTS

| | | | | |
|---|---|---|---|---|
| 5,058,345 | A * | 10/1991 | Martinez | B21F 27/128 29/432 |
| 6,263,629 | B1 * | 7/2001 | Brown, Jr. | E04C 2/044 442/179 |
| 6,655,416 | B2 | 12/2003 | Serillon | |
| 7,162,845 | B2 * | 1/2007 | Messiqua | E04B 2/8635 52/404.1 |
| 8,142,102 | B2 * | 3/2012 | Wheatley | E01C 11/005 404/31 |
| 8,312,683 | B2 * | 11/2012 | Tadros | E04C 2/044 52/309.11 |
| 8,367,569 | B2 * | 2/2013 | Wheatley | C04B 28/02 442/312 |
| 9,034,775 | B2 * | 5/2015 | Wheatley | C04B 28/02 442/149 |
| 9,085,899 | B1 * | 7/2015 | Bertrand | E04C 2/296 |
| 9,663,950 | B2 * | 5/2017 | Karle | E04C 2/06 |
| 2004/0020149 | A1 * | 2/2004 | Messiqua | E04B 2/8635 52/426 |
| 2007/0272353 | A1 * | 11/2007 | Wheatley | E01D 19/00 156/304.3 |
| 2009/0007519 | A1 * | 1/2009 | Keshishian | E04C 2/044 52/794.1 |
| 2010/0117249 | A1 * | 5/2010 | Echauri Senosiain | B28B 23/028 264/35 |
| 2011/0047918 | A1 * | 3/2011 | Wehrli | E04B 1/4121 52/506.03 |
| 2011/0061329 | A1 * | 3/2011 | Tadros | E04C 2/044 52/583.1 |
| 2013/0295378 | A1 * | 11/2013 | Bonin | E04B 2/8611 428/337 |
| 2014/0000204 | A1 * | 1/2014 | Wu | E04B 1/7629 52/506.05 |
| 2015/0132533 | A1 * | 5/2015 | Karle | E04C 2/06 428/107 |
| 2015/0204074 | A1 * | 7/2015 | Bauermeister | E04C 3/294 52/378 |

FOREIGN PATENT DOCUMENTS

| | | | | |
|---|---|---|---|---|
| JP | 2001311248 | | 11/2001 | |
| JP | 2006118236 | | 5/2006 | |
| JP | 2007046364 | | 2/2007 | |
| JP | 6174508 | | 8/2017 | |
| KR | 1020030038135 | | 5/2003 | |
| KR | 1003875500000 | | 6/2003 | |
| KR | 1020080101218 | | 11/2008 | |
| KR | 1017522750000 | | 6/2017 | |
| NL | 1006527 | C2 * | 1/1999 | E02D 27/01 |

* cited by examiner

HIGHLY DURABLE TEXTILE REINFORCING PANEL USED AS CONCRETE FORM, AND METHOD OF CONSTRUCTING REINFORCED CONCRETE STRUCTURE USING THE SAME

CROSS-REFERENCE TO RELATED APPLICATION

This application claims priority to and the benefit of Korean Patent Application No. 10-2017-0146077, filed on Nov. 3, 2017, the disclosure of which is incorporated herein by reference in its entirety.

BACKGROUND

1. Field of the Invention

The present invention relates to a highly durable textile reinforcing panel used as a concrete form and, more specifically, a highly durable textile reinforcing panel used as a concrete form, which is a highly durable concrete panel for a permanent concrete form applied when a concrete structure is constructed, resists a lateral pressure caused due to a self-load of concrete during construction, and functions as a structure reinforcing material by being integrated with the concrete cured after the construction, and a method of constructing a reinforced concrete structure using the same.

2. Discussion of Related Art

Generally, when a structure such as a building is constructed, that is, a column, a beam, a wall, and the like of a building are constructed, a plurality of concrete forms formed with a unit panel are coupled to form one wall, and a support is supported using plywood and rectangular timber to form a slab, or fresh concrete is poured in the concrete forms forming a surface of the wall and a surface of the slab to simultaneously form both the wall and the slab.

The concrete form is a structure which is a structure temporarily installed to form fresh concrete into a predetermined shape and dimension during construction of a reinforced concrete structure or a steel-framed reinforced concrete structure. The concrete form is necessary for a short period of time until the concrete is almost cured and is a temporary member to be removed after the concrete is cured, and tasks of assembling and disassembling the concrete form are inconvenient processes which are a large part of costs and time required for the overall construction. Particularly, a self-load of the concrete form is high, and thus tasks of assembling and disassembling a concrete form in a high place may involve risk.

FIGS. 1A to 1D are views showing a process of constructing a reinforced concrete beam using a concrete form according to a related art.

As shown in FIG. 1A, a concrete form 11 is installed to correspond to a shape of a beam to be installed. As shown in FIG. 1B, a reinforcing bar 12 is arranged in the concrete form 11 to form a reinforcing supporting part. As shown in FIG. 1C, concrete 13 is poured in the concrete form and cured. Lastly, as shown in FIG. 1D, the concrete form 11 is removed after the concrete 13 is cured. Thus, a series of processes are performed to complete a required shape of a structure.

Meanwhile, construction of a reinforcing concrete structure includes assembling a reinforcing bar, installing a concrete form corresponding to an appearance of the structure on one side or both sides of the structure, and pouring fresh concrete into the concrete form to complete the construction thereof, and concrete having a material property equivalent to a design strength, etc., has been used in construction.

A concrete material has wholly excellent durability but has problems in that the concrete material is easily deteriorated when exposed to a chemical material, such as waste water and the like, is neutralized when in contact with air for a long time, and allows a reinforcing bar to corrode when water penetrates into the concrete.

A recently developed carbon fiber concrete form method is a method of pre-manufacturing a concrete form in a shape of a concrete form to be formed using a carbon fiber sheet and using the concrete form in place of a conventional tie bar. When the carbon fiber concrete form method is used, the amount of tie bars is minimized, and thus personnel expenses and a construction period can be reduced. Further, depending on a construction method, it is not necessary for the concrete form to be removed after a single surface is constructed, and thus construction performance can be remarkably improved.

There is a method for increasing a property of an existing reinforced concrete structure using a carbon fiber sheet which increases flexural strength and ductility of the structure by attaching the carbon fiber sheet to a beam, a bottom plate, a column, and the like of the structure. However, the method is applied to a reinforcing and repairing method for increasing performance of an existing old structure.

As a related art, Korean Laid-open Patent Application No. 2003-38135 discloses an invention entitled "A Concrete Construction Method Using Carbon Fiber Mold," and the method will be described with reference to FIG. 2.

FIG. 2 is a conceptual view of construction of a plain concrete member using a carbon fiber concrete form according to the related art.

As shown in FIG. 2, the plain concrete member using the carbon fiber concrete form according to the related art is used in place of a structure member of buildings in a reinforced concrete structure and a steel frame structure by filling a manufactured carbon fiber concrete form 20 with concrete 30.

A method of constructing a concrete structure using a carbon fiber concrete form as a permanent concrete form according to the related art is a construction method for effectively constructing a concrete structure by using a carbon fiber frame used in place of a concrete form as a permanent concrete form, and also using the carbon fiber concrete Ruin as a part of the concrete structure when a pier, a foundation, a slab, and the like of a building and civil works is constructed.

Specifically, when a concrete structure is built during construction of a foundation, a pier, a slab, and the like of a building or civil works for constructing a basement part and a ground part, the method for constructing a concrete structure using a carbon fiber concrete form as a permanent concrete form according to the related art includes: manufacturing concrete forms with various shapes using carbon fiber; installing the manufactured carbon fiber concrete form at a portion at which a foundation, a pier, a slab, and the like will be built or a portion at which a column, a beam, a wall, the slab, and the like will be built; pouring and curing fresh concrete in the installed carbon fiber concrete form; and using the carbon fiber concrete form as a part of the structure after the concrete is poured and cured.

According to the method for constructing a concrete structure using a carbon fiber concrete form as a permanent concrete form according to the related art, the carbon fiber concrete form 20 with concrete therein is used as a basement frame as it is without being disassembled after foundation pouring to increase stiffness of a retaining wall support and provide excellent constructability such as reduction of a construction time, unlike a conventionally used concrete form.

However, in the case of the method for constructing a concrete structure using a carbon fiber concrete form as a permanent concrete form according to the related art, the carbon fiber concrete form 20 is filled with concrete to be integrated without a shear connector, and thus there is a problem in that a connection between the carbon fiber concrete form 20 and a poured concrete structure is weak.

FIG. 3 is a view for describing a concept of pouring fresh concrete using a permanent concrete form according to the related art.

As shown in FIG. 3, a permanent concrete form 40 is used to increase constructability of a concrete structure but, according to the related art, a separate connector should be provided so that the permanent concrete form 40 is integrated with a poured concrete object 50. For example, because a stud connector 41 is installed in the permanent concrete form 40 in advance, a process of a secondary task, such as welding for installing a separate stud after the permanent concrete form 40 is manufactured, is increased, and thus there is a disadvantage of an increase in personnel expenses and material costs for the process.

Also, according to the related art, a panel is applied only as a substitute for a concrete form, which is not a structure, and a separate reinforcing material or a tie is formed to support a lateral pressure when the concrete is poured.

Also, the permanent concrete form according to the related art is not integrated with a structure after construction, cannot increase a structural stiffness, and cannot suppress damage or deterioration of a structure.

PATENT DOCUMENTS

Korean Laid-open Patent Application No. 2003-38135 (Published on May 16. 2003) entitled "A Concrete Construction Method Using Carbon Fiber Mold"

Korean Laid-open Patent Application No. 2008-101218 (Published on Nov. 21. 2008), entitled "Concrete Structure with Fireproof Board Constant Foam and Execution Method"

Japanese Patent No. 6,174,508 (Published on Jul. 14. 2017) entitled "Reinforcing Panel, Method of Manufacturing Reinforcing Panel, Concrete Structure, and Method of Constructing Concrete Structure"

Japanese Patent Application Laid-Open No. 2006-118236 (Published on May 11. 2006), entitled "Fiber Reinforced Concrete Permanent Concrete form"

Korean Laid-open Patent Registration No. 10-387550 (Published on Jun. 2. 2003), entitled "Carbon Fiber Mold for Seismic Pier of Bridge and method Thereof and Constructing Method of Seismic Pier Using its Mold"

Korean Laid-open Patent Registration No. 10-1752275 (Published on Jun. 23. 2017) entitle "Structural Mold for Reinforced Concrete Column using Profiled Steel Plate"

Japanese Patent Application Laid-Open No. 2001-311248 (Published on Nov. 9. 2001) entitled "Concrete Panel for Permanent Concrete form and Manufacturing Method Thereof"

Japanese Patent Application Laid-Open No. 2007-46364 (Published on Feb. 22. 2007) entitled "Fiber Reinforcing Resin Permanent Concrete form for Reinforced Concrete Upper Plate, Manufacturing Method Thereof, and Reinforced Concrete Combined Upper Plate Using Permanent Concrete form"

SUMMARY OF THE INVENTION

The present invention is directed to a highly durable textile reinforcing panel used as a concrete form, which is a highly durable textile reinforcing panel for a permanent concrete form applied when a concrete structure is constructed, resists a lateral pressure caused due to a self-load of concrete which is not cured during construction, and functions as a structure reinforcing material by being integrated with concrete cured after the construction, and a method for constructing a reinforced concrete structure using the same.

The present invention is directed to a highly durable textile reinforcing panel used as a concrete form which is integrated with a concrete structure via a textile shear connector formed on a highly durable concrete panel, and remarkably increases a flexural strength of the highly durable concrete panel using a lattice-shaped reinforcing material, and a method for constructing a reinforced concrete structure using the same.

According to an aspect of the present invention, there is provided a highly durable textile reinforcing panel used as a concrete form, which is formed on one side of a structure when a reinforced concrete structure is constructed, includes a highly durable concrete panel formed of a high stiffness and durability material with a predetermined thickness and configured to function as a permanent concrete form for constructing a reinforced concrete structure, and a panel reinforcing textile including a latticed textile reinforcing material for reinforcing the highly durable concrete panel and textile shear connectors and formed such that the textile shear connectors are partially exposed to one side of the highly durable concrete panel, wherein the panel reinforcing textile includes the latticed textile reinforcing material embedded in the highly durable concrete panel and the plurality of textile shear connectors which are a shear connector partially exposed to the one side of the highly durable concrete panel and formed on the latticed textile reinforcing material.

The highly durable concrete panel may be configured to resist a lateral pressure caused due to a self-load of concrete which is not cured when the reinforced concrete structure is constructed and function as a structure reinforcing material by being integrated with cast-in-place concrete after the reinforced concrete structure is constructed.

The cast-in-place concrete, which is general concrete for forming a reinforced concrete structure, may be connected and integrated with the highly durable concrete panel via the exposed textile shear connectors.

The textile shear connectors coupled to the latticed textile reinforcing material may be partially exposed to the outside of the panel to be shear-connected with the cast-in-place concrete.

According to another aspect of the present invention, there is provided a method for constructing a reinforced concrete structure using a highly durable textile reinforcing panel used as a concrete form which includes a) forming a panel reinforcing textile by textile shear connectors being coupled onto a latticed textile reinforcing material, b) forming a highly durable textile reinforcing panel used as a concrete form by pouring highly durable fresh concrete such that the textile shear connectors of the panel reinforcing textile are partially exposed to one side of the highly durable concrete panel, c) putting the highly durable textile reinforcing panel used as a concrete form on one side of a reinforced concrete structure as a permanent concrete form and putting a general concrete form on the other side thereof, d) assembling and putting a longitudinal reinforcing bar and a transverse reinforcing bar between the permanent concrete form and the general concrete form, and e) forming the reinforced concrete structure by pouring fresh cast-in-place concrete on the exposed textile shear connectors, the longitudinal reinforcing bar, and the transverse reinforcing bar, wherein the cast-in-place concrete is connected with the exposed textile shear connectors to form the reinforced concrete structure integrated with the highly durable textile reinforcing panel used as a concrete form.

The highly durable concrete panel in operation b) may be made of a high stiffness and durability material with a predetermined thickness to function as the permanent concrete form.

The panel reinforcing textile in operation a) may include the latticed textile reinforcing material embedded in the highly durable concrete panel and the textile shear connectors, which are shear-connectors exposed to one side of the highly durable concrete panel, are formed on the latticed textile reinforcing material.

The reinforced concrete structure may be a structure which is in contact with water, a chemical material, or air, and the highly durable textile reinforcing panel used as a concrete form may be installed on a side surface or a lower surface of the structure.

The highly durable concrete panel may be configured to resist a lateral pressure caused due to a self-load of concrete which is not cured when the reinforced concrete structure is constructed and function as a structural reinforcing material by being integrated with the cast-in-place concrete after the reinforced concrete structure is constructed.

The cast-in-place concrete, which is general concrete for forming a reinforced concrete structure, may be connected with the highly durable concrete panel via the exposed textile shear connectors.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1D:
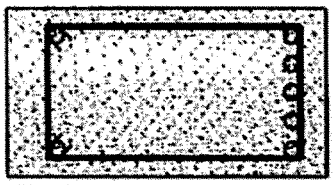
FIG. 1D (RELATED ART)
FIGS. 1A to 1D are views showing a process of constructing a reinforced concrete beam using a concrete form according to a related art.
Figure 1C:
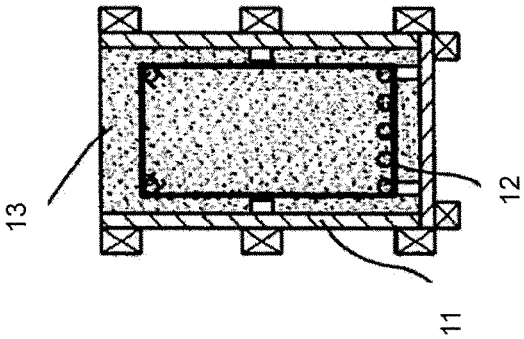
FIG. 1C (RELATED ART)
Figure 1B:
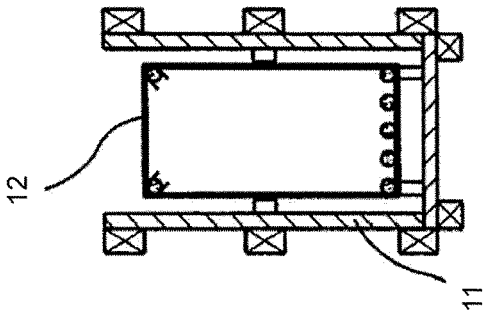
FIG. 1B (RELATED ART)
Figure 1A:
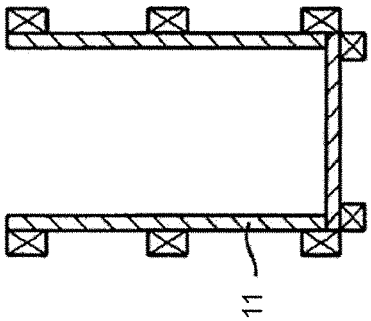
FIG. 1A (RELATED ART)
Figure 2:
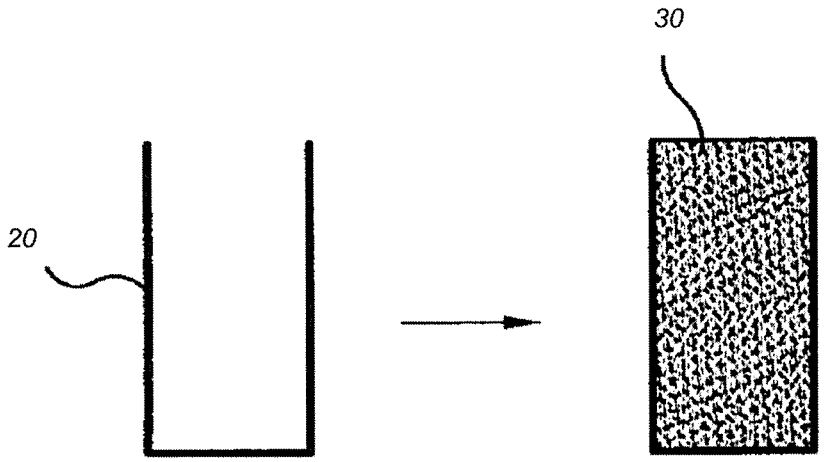
FIG. 2 (RELATED ART)
FIG. 2 is a conceptual view of construction of a plain concrete member using a carbon fiber concrete form according to the related art.
Figure 3:
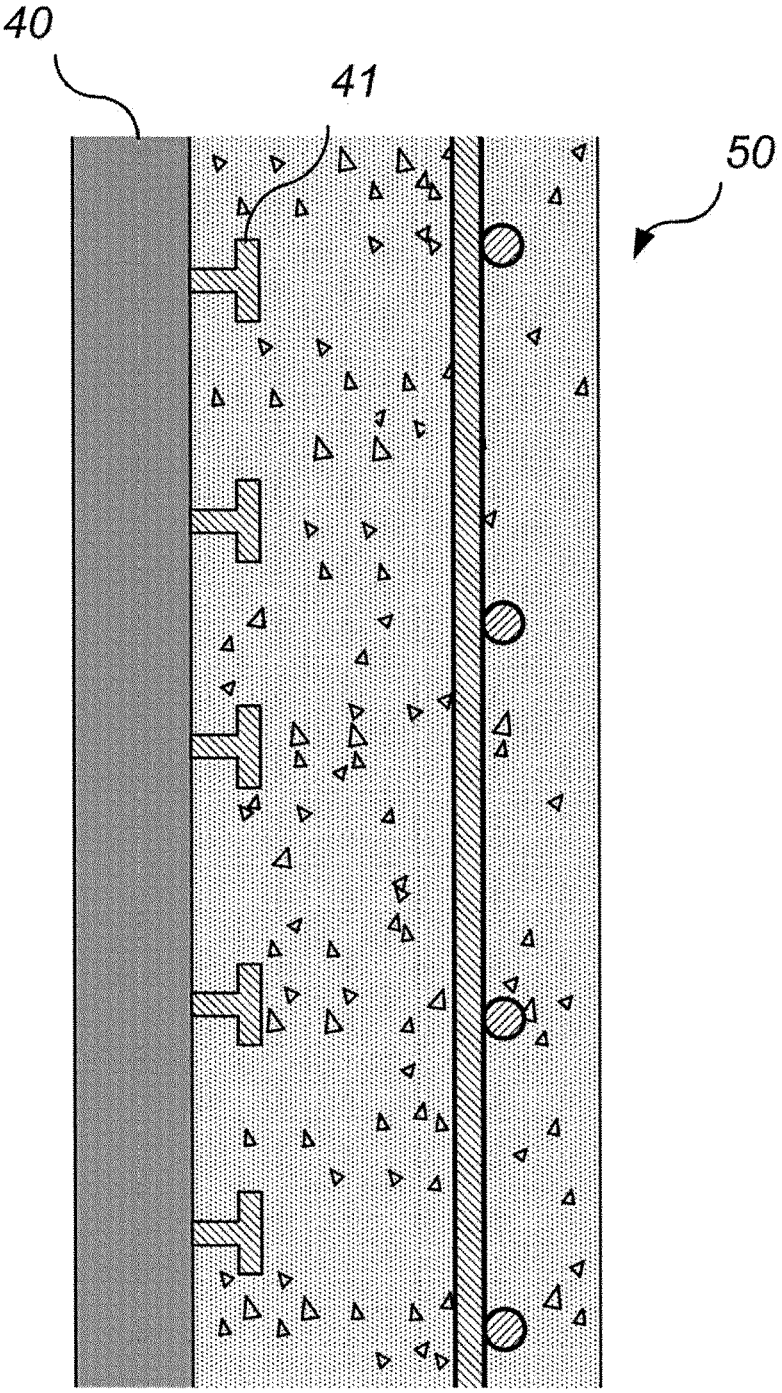
FIG. 3 (RELATED ART)
FIG. 3 is a view showing a concept of pouring fresh concrete using a permanent concrete form according to the related art.

Hereinafter, embodiments that are easily performed by those skilled in the art will be described in detail with reference to the accompanying drawings. However, embodiments of the present invention may be implemented in several different concrete forms and are not limited to embodiments described herein. In addition, parts irrelevant to description will be omitted in the drawings to clearly explain embodiments of the present invention. Similar parts are denoted by similar reference numerals throughout this specification.

Throughout the specification, when a portion "includes" an element, the portion may include the element or another element may be further included therein, unless otherwise described.

[Highly Durable Textile Reinforcing Panel Used as Concrete Form 110]

Figure 4:
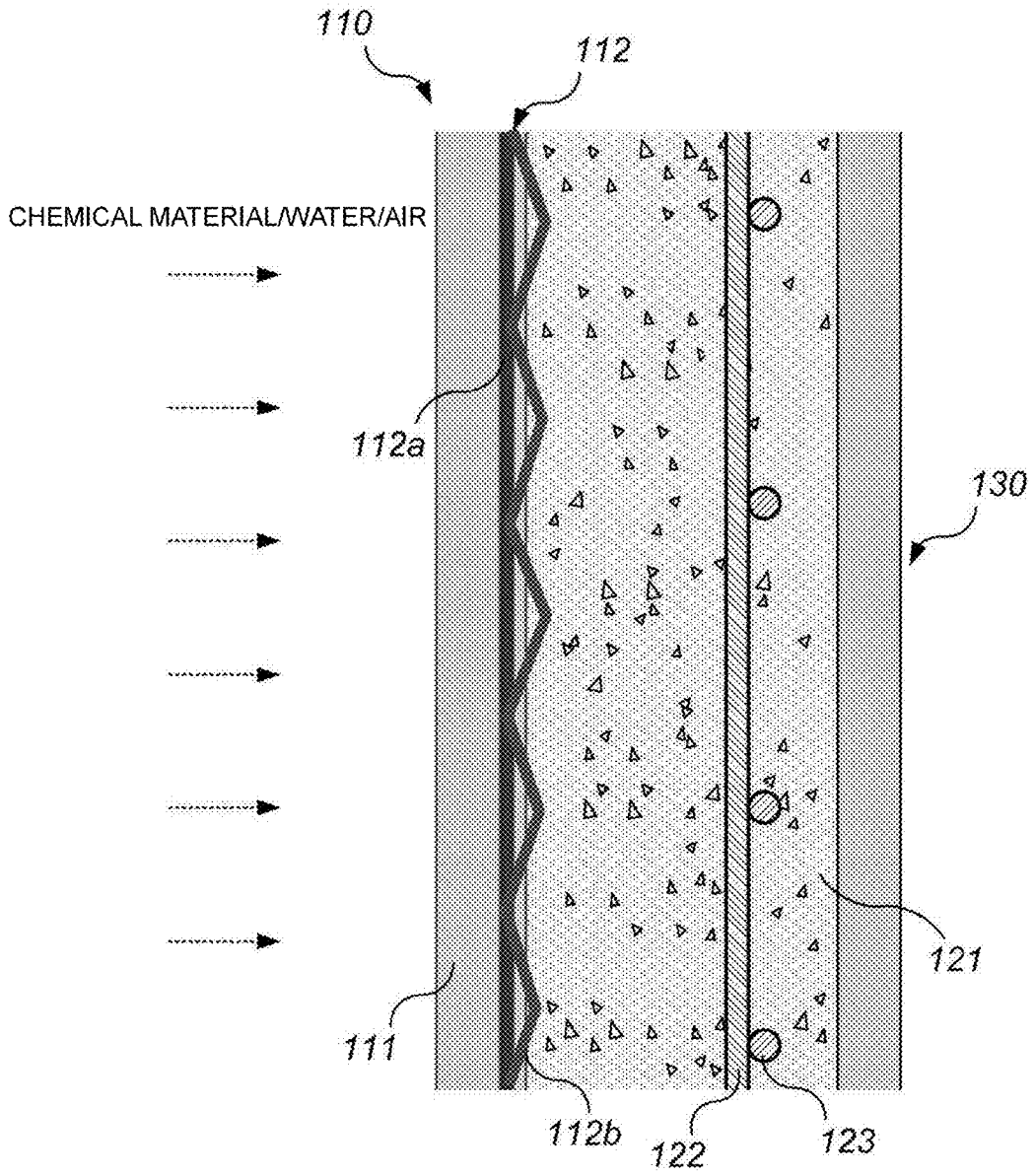
FIG. 4 is a side view showing a highly durable textile reinforcing panel used as a concrete form according to one embodiment of the present invention.
Figure 5:
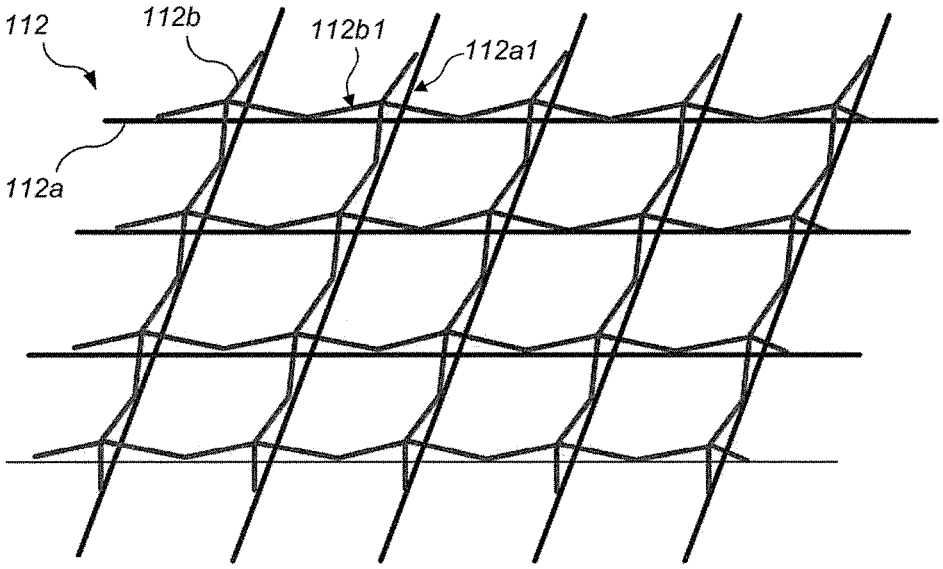
FIG. 5 is a view illustrating a panel reinforcing textile of the highly durable textile reinforcing panel used as a concrete form according to one embodiment of the present invention.

FIG. 4 is a side view showing a highly durable textile reinforcing panel used as a concrete form according to one embodiment of the present invention, and FIG. 5 is a view illustrating a panel reinforcing textile of the highly durable textile reinforcing panel used as a concrete form according to one embodiment of the present invention.

Referring to FIGS. 4 and 5, the highly durable textile reinforcing panel used as a concrete form according to one embodiment of the present invention, which is a textile reinforcing panel formed at one side of a structure when a reinforced concrete structure is constructed, includes a highly durable concrete panel 111 and a panel reinforcing textile 112.

The highly durable concrete panel 111 is made of a high stiffness and durability material with a predetermined thickness, and functions as a permanent concrete form for constructing a reinforced concrete structure. In this case, the highly durable concrete panel 111, for example, may be formed with concrete with high stiffness or highly functional concrete, but is not limited thereto.

The panel reinforcing textile 112 includes a textile shear connector 112*b* and a latticed textile reinforcing material 112*a* for reinforcing the highly durable concrete panel 111, and a part of the textile shear connector 112*b* is formed to be exposed to one side of the highly durable concrete panel 111. For example, as shown in FIG. 5, the panel reinforcing textile 112 is formed in a closed wave shape or an open V shape, and the part of the panel reinforcing textile 112 is exposed to the outside of the panel to be shear-connected with cast-in-place concrete 121, but the panel reinforcing textile 112 is not limited thereto.

Specifically, as shown in FIG. 5, the panel reinforcing textile 112 may include the latticed textile reinforcing material 112*a* embedded in the highly durable concrete panel 111, and a plurality of textile shear connectors 112*b* which are shear connectors partially exposed to the one side of the highly durable concrete panel 111 and are formed on the latticed textile reinforcing material 112*a*. As shown in FIG. 5, both the latticed textile reinforcing material 112*a* and the textile shear connectors 112*b* may have a net structure. As shown in FIG. 5, the net structure 112*a*1 of the latticed textile reinforcing material 112*a* is aligned with and corresponds in shape and size to the net-like structure 112*b*1 of the textile shear connectors 112*b*.

In the case of the highly durable textile reinforcing panel used as a concrete form according to one embodiment of the present invention, as shown in FIG. 4, when a reinforced concrete structure is constructed, the highly durable concrete panel 111 with the predetermined thickness is formed at one side of the concrete structure which is in contact with water, a chemical material and air in place of a concrete form, a general concrete form 130 is put on the other side of the concrete structure, and the cast-in-place concrete 121 is poured into the general concrete form 130, and thus durability of the entire concrete structure is ensured and economic feasibility thereof is remarkably increased.

Therefore, the highly durable concrete panel 111 may resist a lateral pressure caused by a self-load of concrete which is not cured when the reinforced concrete structure is constructed, and may function as a structure reinforcing material by being integrated with cast-in-place concrete cured after the reinforced concrete structure is constructed.

Figure 6:
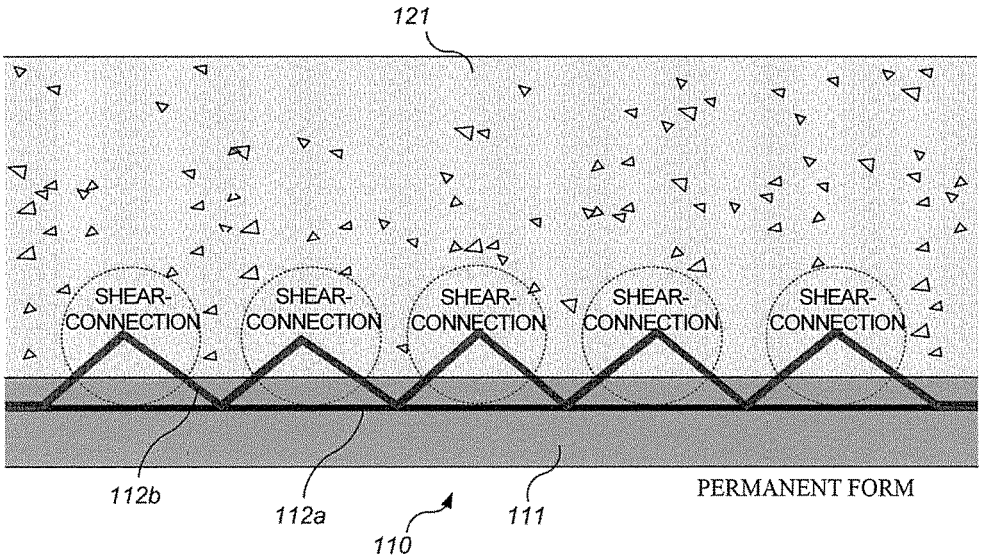
FIG. 6 is a view showing a shear connection of the panel reinforcing textile of the highly durable textile reinforcing panel used as a concrete form according to one embodiment of the present invention.

Meanwhile, FIG. 6 is a view showing a shear connection of the panel reinforcing textile of the highly durable textile reinforcing panel used as a concrete form according to one embodiment of the present invention.

The highly durable textile reinforcing panel used as a concrete form according to one embodiment of the present invention functions as a concrete form during construction, functions as a structure reinforcing material by being integrated with the cast-in-place concrete 121 poured after the construction, and resists an environment. In this case, the cast-in-place concrete 121 is general concrete forming a reinforced concrete structure and, as shown in FIG. 6, is connected and integrated with the highly durable concrete panel 111 via the exposed textile shear connector 112*b*.

Particularly, the highly durable textile reinforcing panel used as a concrete form according to one embodiment of the present invention needs high stiffness to function as a concrete form and a structural reinforcing material, and it is important for the highly durable textile reinforcing panel used as a concrete form to be integrated with the cast-in-place concrete 121 according to a material property after the construction, and thus the highly durable textile reinforcing panel used as a concrete form is reinforced by the latticed textile reinforcing material 112*a* for panel reinforcement with high stiffness and high durability, and the textile shear connectors 112*b* are coupled to the latticed textile reinforcing material 112*a*.

Figure 7:
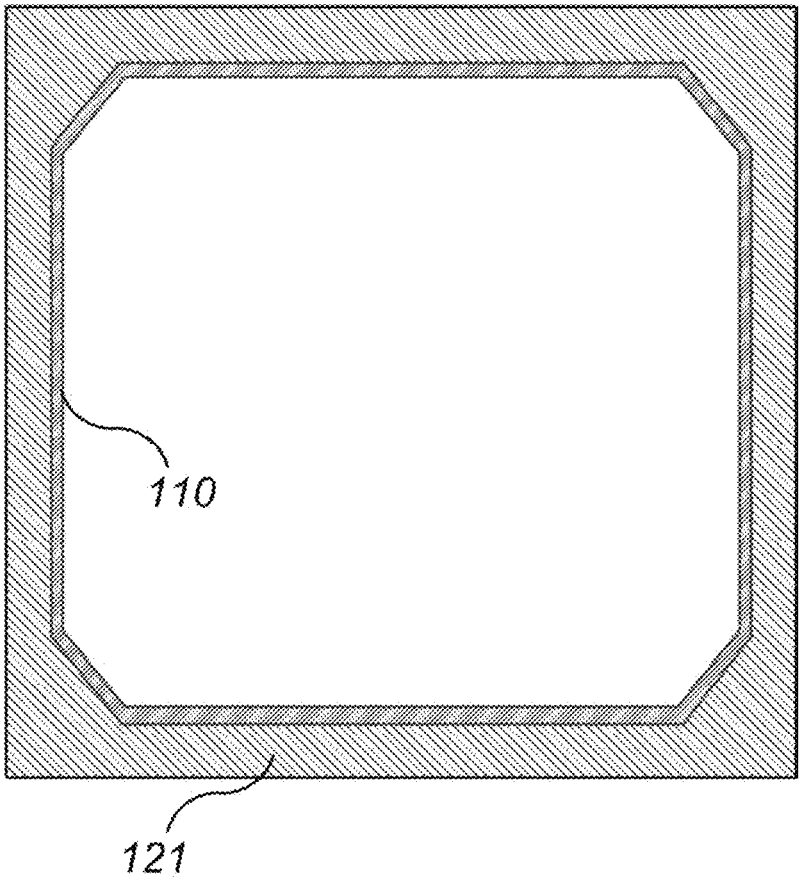
FIG. 7 is a view illustrating a waste water pipe constructed using the highly durable textile reinforcing panel used as a concrete form according to one embodiment of the present invention.

Meanwhile, FIG. 7 is a view illustrating a waste water pipe constructed using the highly durable textile reinforcing panel used as a concrete form according to one embodiment of the present invention.

As shown in FIG. 7, the highly durable textile reinforcing panel used as a concrete form 110 according to one embodiment of the present invention is provided on a wall, an upper slab, and a lower slab of a waste water pipe to reduce a construction time by omitting a separate process of removing the concrete form when the waste water pipe is constructed, and thus construction costs may be reduced.

For example, the highly durable textile reinforcing panel used as a concrete form 110 according to one embodiment of the present invention protects the waste water pipe from a chemical material, such as sulfuric acid of waste water, to more remarkably increase durability than that of a pipe applied with general concrete according to a related art, and thus damage and deterioration of the waste water pipe may be barely generated and maintenance costs thereof may be reduced due to an extended service life. Further, the highly durable textile reinforcing panel used as a concrete form 110 is integrated with a general concrete structure by the textile shear connector 112*b* formed on the highly durable textile reinforcing panel used as a concrete form 110 according to one embodiment of the present invention. The stiffness of the highly durable textile reinforcing panel is remarkably increased by the latticed textile reinforcing material 112*a*, and thus a stiffness of the entire concrete structure may be remarkably increased when the highly durable textile reinforcing panel as a concrete form 110 is structurally integrated with the general concrete structure.

Therefore, according to one embodiment of the present invention, the highly durable textile reinforcing panel used as a concrete form 110, which is a highly durable textile reinforcing panel for a permanent concrete form applied when a concrete structure is constructed, may resist a lateral pressure caused due to a self-load of concrete which is not cured during construction, and may function as a structure reinforcing material by being integrated with concrete cured after the construction.

According to one embodiment of the present invention, the highly durable textile reinforcing panel used as a concrete form 110 is integrated with a concrete structure by a textile shear connector formed on the highly durable concrete panel, and has a flexural strength of the highly durable concrete panel increased by a latticed reinforcing material to increase a flexural strength of the entire concrete structure when the highly durable textile reinforcing panel used as a concrete form 110 is structurally integrated with the concrete structure.

According to one embodiment of the present invention, the highly durable textile reinforcing panel used as a concrete form 110 has a more remarkably increased durability than that of a structure applied only with general concrete in the related art when a highly durable concrete panel is applied to suppress damage and deterioration of the concrete structure, thereby extending a service life of the concrete structure and reducing maintenance costs.

[Method for Constructing Reinforced Concrete Structure Using Highly Durable Textile Reinforcing Panel Used as Concrete Form]

Figure 8:
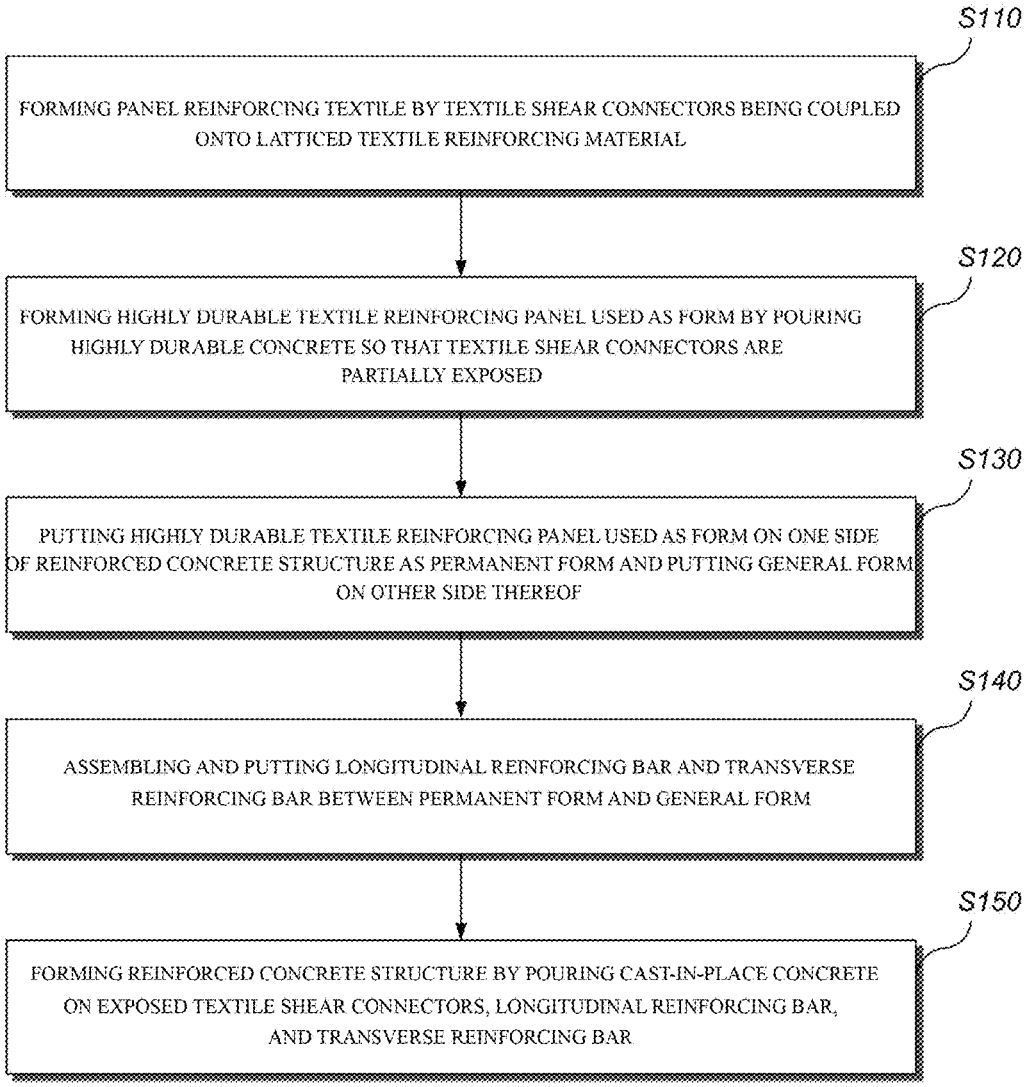
FIG. 8 is a flowchart showing a method for constructing a reinforced concrete structure using the highly durable textile reinforcing panel used as a concrete form according to one embodiment of the present invention.

FIG. 8 is a flowchart showing a method for constructing a reinforced concrete structure using the highly durable textile reinforcing panel used as a concrete form according to one embodiment of the present invention.

Referring to FIGS. 4 and 8, the method for constructing a reinforce concrete structure using the highly durable textile reinforcing panel used as a concrete form according to one embodiment of the present invention is as follows. A textile shear connector 112*b* is coupled to a latticed textile reinforcing material 112*a* to form a panel reinforcing textile 112 (S110). In this case, the panel reinforcing textile 112 may include the latticed textile reinforcing material 112*a* embedded in a highly durable concrete panel 111, and a plurality of textile shear connectors 112*b* which are shear connectors partially exposed to one side of the highly durable concrete panel 111 and formed on the latticed textile reinforcing material 112*a*. In this case, the textile shear connectors 112*b* have a closed wave shape or an open V shape and are partially exposed to the outside of the panel to be shear-connected with cast-in-place concrete 121. That is, the textile shear connectors 112*b* having a closed wave shape or an open V shape are integrally connected to the latticed textile reinforcing material 112*a* made of carbon fiber, and the textile shear connector 112*b* is partially exposed after the textile reinforcing panel is manufactured.

Next, highly durable concrete is poured so that the part of the textile shear connector 112*b* of the panel reinforcing textile 112 is exposed to one side of the highly durable concrete panel 111, and a highly durable textile reinforcing panel used as a concrete form 110 is formed (S120). In this case, the highly durable concrete panel 111 is made of a high stiffness and durability material with a predetermined thickness to function as a permanent concrete form. The highly durable concrete panel 111 may resist a lateral pressure caused due to a self-load of concrete which is not cured when the reinforced concrete structure is constructed, and may function as a structure reinforcing material by being integrated with the cast-in-place concrete after the reinforced concrete structure is constructed.

The highly durable textile reinforcing panel used as a concrete form 110 is put on one side of the reinforced concrete structure as a permanent concrete form, and, as shown in FIG. 4, a general concrete form 130 is put on the other side thereof (S130).

A longitudinal reinforcing bar 122 and a transverse reinforcing bar 123 are assembled and put between the permanent concrete form and the general concrete form 130 (S140).

The cast-in-place concrete 121 is poured onto the exposed textile shear connector 112*b*, the longitudinal reinforcing bar 122, and the transverse reinforcing bar 123 to form the reinforced concrete structure (S150).

Therefore, the cast-in-place concrete 121 is connected with the exposed textile shear connector 112*b*, and thus the reinforced concrete structure integrated with the highly durable textile reinforcing panel used as a concrete form 110 may be constructed. Further, the cast-in-place concrete 121, which is general concrete forming a reinforced concrete structure, may be connected and integrated with the highly durable concrete panel 111 via the exposed textile shear connector 112*b*.

The reinforced concrete structure is a structure which is in contact with water, a chemical material, or air, for example, a waste water pipe, and the highly durable textile reinforcing panel used as a concrete form 110 may be installed on a side or lower surface of the structure as a permanent concrete form.

Therefore, the highly durable textile reinforcing panel used as a concrete form 110 according to one embodiment of the present invention may be applied to a permanent concrete form for a wall and a slab of a building or civil works, may be applied to a damage and deterioration prevention dam, such as a waterfront structure, a structure for waste water, and the like, and may be also applied for reinforcement or maintenance of a wall and a slab of an existing structure.

According to the present invention, the highly durable textile reinforcing panel used as a concrete form, which is a highly durable textile reinforcing panel for a permanent concrete form applied when a concrete structure is constructed, resists a lateral pressure caused due to a self-load of concrete which is not cured during construction, and functions as a structure reinforcing material by being integrated with concrete cured after the construction, can be provided.

According to the present invention, the highly durable textile reinforcing panel used as a concrete form is integrated with a concrete structure by a textile shear connector formed on a highly durable concrete panel, and allows a lattice-shaped reinforcing material to remarkably increase a flexural strength of the highly durable concrete panel to increase a flexural strength of the entire concrete structure when the highly durable textile reinforcing panel used as a concrete form is structurally integrated with the concrete structure.

According to the present invention, the highly durable textile reinforcing panel used as a concrete form has, when a highly durable concrete panel is applied thereto, a durability more remarkably increased than that of a structure applied only with general concrete in a related art to suppress damage and deterioration of a concrete structure and thus to extend a service life of the concrete structure and reduce maintenance costs.

The above description is only exemplary, and it should be understood by those skilled in the art that the invention may be performed in other concrete forms without changing the technological scope and essential features. Therefore, the above-described embodiments should be considered only as examples in all aspects and not for purposes of limitation. For example, each component described as a single type may be realized in a distributed manner, and similarly, components that are described as being distributed may be realized in a coupled manner.

The scope of the present invention is defined not by the detailed description but by the appended claims, and encompasses all modifications or alterations derived from the meanings, scope, and equivalents of the appended claims.

What is claimed is:

1. A highly durable textile reinforcing panel used as a permanent concrete form formed on one side of a reinforced concrete structure when the reinforced concrete structure is constructed, the panel comprising:

a highly durable concrete panel composed of a high stiffness and durability material with a predetermined thickness and configured to function as the permanent concrete form for constructing the reinforced concrete structure; and a panel reinforcing textile including (i) a latticed textile reinforcing material configured for reinforcing the highly durable concrete panel and (ii) a plurality of textile shear connectors coupled to the latticed textile reinforcing material and formed such that the textile shear connectors are partially exposed to one side of the highly durable concrete panel, wherein the panel reinforcing textile includes the latticed textile reinforcing material embedded in the highly durable concrete panel and the plurality of textile shear connectors which are shear connectors partially exposed to the one side of the highly durable concrete panel and formed on the latticed textile reinforcing material, wherein a net structure of the latticed textile reinforcing material is aligned with and corresponds in shape and size to a V-shaped net structure of the textile shear connectors.

2. The panel of claim 1, wherein the textile shear connectors coupled to the latticed textile reinforcing material are partially exposed to the one side of the highly durable concrete panel to be shear-connected with a cast-in-place concrete.

3. The panel of claim 1, wherein the highly durable concrete panel is configured to resist a lateral pressure caused due to a self-load of concrete which is not cured when the reinforced concrete structure is constructed and function as a structure reinforcing material by being integrated with cast-in-place concrete after the reinforced concrete structure is constructed.

4. The panel of claim 3, wherein the cast-in-place concrete, which is general concrete for forming the reinforced concrete structure, is connected and integrated with the highly durable concrete panel via the exposed textile shear connectors.

5. A method for constructing a reinforced concrete structure using a highly durable textile reinforcing panel used as a permanent concrete form, the method comprising:

a) forming a panel reinforcing textile by textile shear connectors being coupled onto a latticed textile reinforcing material;

b) forming the highly durable textile reinforcing panel of claim 1 by pouring highly durable fresh concrete such that the textile shear connectors of the panel reinforcing textile are partially exposed to the one side of the highly durable concrete panel;

c) putting the highly durable textile reinforcing panel on the one side of the reinforced concrete structure as the permanent concrete form and putting a general concrete form on a second side thereof;

d) assembling and putting a longitudinal reinforcing bar and a transverse reinforcing bar between the permanent concrete form and the general concrete form; and e) forming the reinforced concrete structure by pouring fresh cast-in-place concrete on the exposed textile shear connectors, the longitudinal reinforcing bar, and the transverse reinforcing bar, wherein the cast-in-place concrete is connected with the exposed textile shear connectors to form the reinforced concrete structure integrated with the highly durable textile reinforcing panel.

6. The method of claim 5, wherein the reinforced concrete structure is a structure, which is in contact with water, a chemical material, or air, and the highly durable textile reinforcing panel used as a concrete form is installed on a side surface or a lower surface of the structure.

7. The method of claim 5, wherein the highly durable concrete panel in operation b) is made of a high stiffness and durability material with a predetermined thickness to function as the permanent concrete form.

8. The method of claim 5, wherein the panel reinforcing textile in operation a) includes:

the latticed textile reinforcing material embedded in the highly durable concrete panel; and the textile shear connectors, which are shear-connectors exposed to the one side of the highly durable concrete panel, are formed on the latticed textile reinforcing material.

9. The method of claim 8, wherein the panel reinforcing textile has a closed wave concrete form or an open V shape, that is partially exposed, and is shear-connected with the cast-in-place concrete.

10. The method of claim 5, wherein the highly durable concrete panel is configured to resist a lateral pressure caused due to a self-load of concrete which is not cured when the reinforced concrete structure is constructed and function as a structural reinforcing material by being integrated with the cast-in-place concrete after the reinforced concrete structure is constructed.

11. The method of claim 10, wherein the cast-in-place concrete, which is general concrete for forming a reinforced concrete structure, is integrally connected with the highly durable concrete panel via the exposed textile shear connectors.

* * * * *